US008256260B2

(12) United States Patent
Mathai et al.

(10) Patent No.: US 8,256,260 B2
(45) Date of Patent: Sep. 4, 2012

(54) NEAR NET SHAPE FORGING PROCESS FOR COMPRESSOR AND TURBINE WHEELS AND TURBINE SPACER WHEELS

(75) Inventors: Manu Mathai, Chennai (IN); Raymond Stonitsch, Simpsonville, SC (US); Guven Yucesan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/017,181

(22) Filed: Jan. 31, 2011

(65) Prior Publication Data

US 2011/0113850 A1 May 19, 2011

Related U.S. Application Data

(62) Division of application No. 11/968,684, filed on Jan. 3, 2008, now Pat. No. 7,895,874.

(51) Int. Cl.

| | |
|---|---|
| ***B21D 22/00*** | (2006.01) |
| ***B21K 25/00*** | (2006.01) |
| ***B23P 15/04*** | (2006.01) |

(52) U.S. Cl. ..... 72/357; 72/353.2; 72/403; 29/889.2

(58) Field of Classification Search ..... 72/352, 72/353.2, 353.6, 354.2, 356, 357, 358, 377; 29/889.2, 889.23

See application file for complete search history.

(56) References Cited

U.S. PATENT DOCUMENTS

| | | | | |
|---|---|---|---|---|
| 1,449,385 | A * | 3/1923 | Dieterich | 72/326 |
| 3,122,823 | A * | 3/1964 | Lazar et al. | 29/889.23 |
| 3,750,442 | A * | 8/1973 | Cogan | 72/352 |
| 5,950,481 | A | 9/1999 | Sarkisian et al. | |
| 6,240,765 | B1 | 6/2001 | Delgado et al. | |

* cited by examiner

*Primary Examiner* — Teresa M Ekiert

(74) *Attorney, Agent, or Firm* — Nixon & Vanderhye, P.C.

(57) ABSTRACT

A forging method including extruding a billet to form a ring shaped hollow workpiece; reducing a cross section of the workpiece; and forging the workpiece in a closed die having a first split die including a plurality of first die segments and a second split die including a plurality of second die segments by sequentially advancing pairs of opposing die segments from the first split die and second split die towards each other.

15 Claims, 6 Drawing Sheets

NEAR NET SHAPE FORGING PROCESS FOR COMPRESSOR AND TURBINE WHEELS AND TURBINE SPACER WHEELS

CROSS-REFERENCE TO RELATED APPLICATION

This application is a divisional of U.S. application Ser. No. 11/968,684, filed Jan. 3, 2008, which is allowed, the entire contents of which is hereby incorporated by reference.

The invention relates to a near net shape forging process for compressor and turbine wheels and turbine spacer wheels. In particular, the invention relates to a near net shape forging process for compressor and turbine wheels and turbine spacer wheels formed of NiCrMoV and CrMoV.

BACKGROUND OF THE INVENTION

Existing forging processes for the manufacture of compressor and turbine wheels rely on open die forging. Open die forging processes require additional input material tonnage and more heat treatment, and more forging processing steps.

Current closed die forging processes involve higher press tonnages. The use of closed die forging requires investments of higher capacity presses. However, there are currently no high capacity presses suitable for economical closed die forging of turbine and compressor wheels and turbine spacer wheels formed, for example, of CrMoV and NiCrMoV.

U.S. Pat. No. 6,240,765 discloses a closed die forging process including a die set having a stationary die and a movable die in facing-but-spaced-apart relation to the stationary die along a press access and defining a work piece volume therebetween. U.S. Pat. No. 6,240,765 starts with a workpiece geometry which covers the entire plan view area of the dies. As the workpiece covers the entire plan view area of the dies, the strain rates to be used are much lower which results in frequent heat treatment steps between the various incremental forging steps. The process of U.S. Pat. No. 6,240,765 therefore requires greater input material tonnage.

BRIEF DESCRIPTION OF THE INVENTION

According to an embodiment of the invention, a method of forging a workpiece comprises (a) incrementally advancing the workpiece in a closed die forge, the closed die forge comprising a stationary, flat die and a first split die comprising a plurality of first die segments, each die segment being incrementally advanced in sequence to contact the incrementally advancing workpiece; (b) replacing the stationary, flat die with a second split die comprising a plurality of second die segments; and (c) forging the workpiece forged in (a) between the first split die and the second split die, wherein the first die segments are stationary and at least some of the plurality of second die segments are incrementally advanced in sequence.

According to another embodiment of the invention, a forging method comprises extruding a billet to form a ring shaped hollow workpiece; reducing a cross section of the workpiece; and forging the workpiece in a closed die comprising a first split die comprising a plurality of first die segments and a second split die comprising a plurality of second die segments.

DETAILED DESCRIPTION OF THE INVENTION

Figure 1:
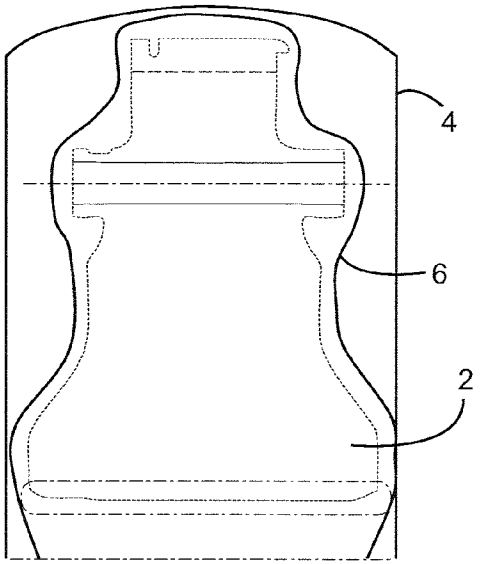
FIG. 1 schematically illustrates the input material for a compressor or turbine wheel according to the prior art and the invention.

Referring to FIG. 1, a turbine or compressor wheel 2 may be forged from a starting workpiece. According to current forging processes, the starting workpiece 4 comprises approximately 30% more material than a starting workpiece 6 according to an embodiment of the invention.

Figure 2:
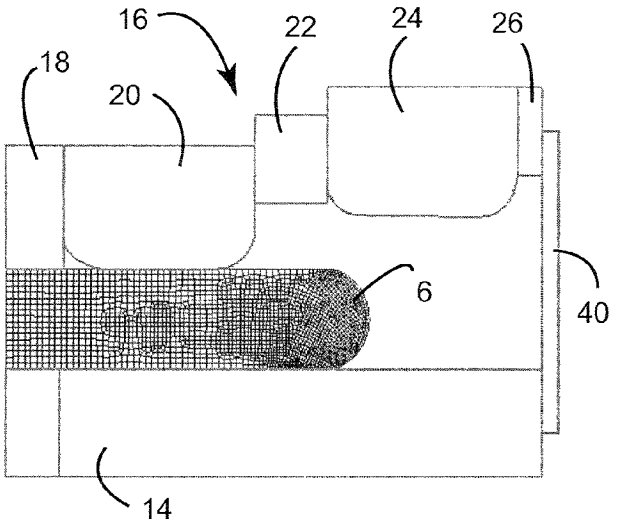
FIG. 2 depicts a first stage preforming process using a flat bottom die and a split top incremental die.
Figure 3:
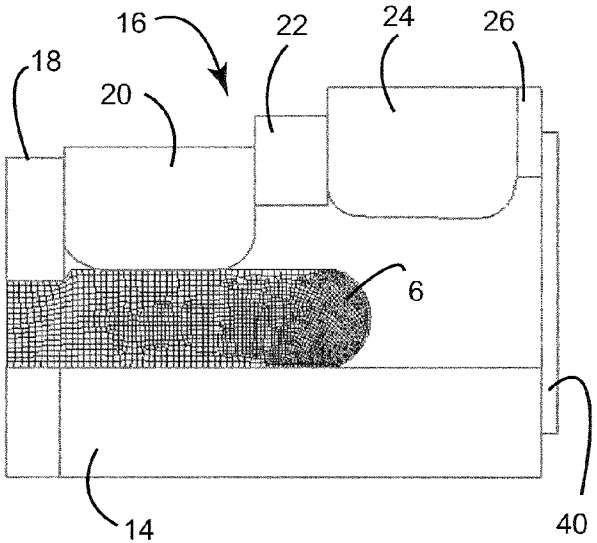
FIG. 3 discloses an incremental advance of a die segment from FIG. 2.

Referring to FIGS. 2 and 3, the first stage preforming may be performed with a closed flat bottom die 14 and a closed top incremental split die 16. The closed top incremental split die 16 includes a closed top die first segment 18, second segment 20, third segment 22, fourth segment 24, and a fifth segment 26. It should be appreciated, however, that the closed top incremental split die may be formed of any number of segments. A stop 40 is provided after the closed top die fifth segment 26 to close the die.

As shown in FIG. 2, the workpiece 6 is initially contacted by the first segment 18 and the second segment 20. The first segment 18 is incrementally advanced as shown in FIG. 3. The first stage preforming shown in FIGS. 4 and 5 is done at a high strain rate such as to minimize die chilling to avoid intermediate reheats of the workpiece 6.

Figure 4:
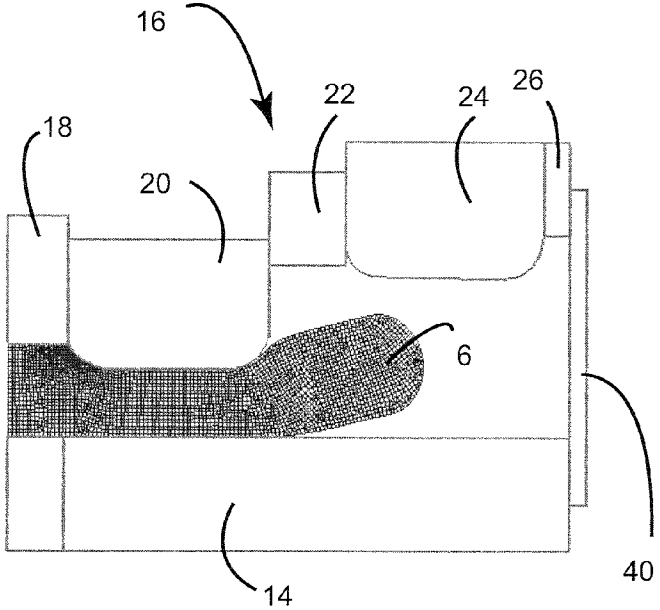
FIG. 4 discloses another advance of an incremental die segment of the first stage preforming.

The closed top die second segment 20 is then incrementally advanced, as shown in FIG. 4. The process details may be designed to eliminate the requirement for an intermediate reheat of the workpiece 6.

Figure 5:
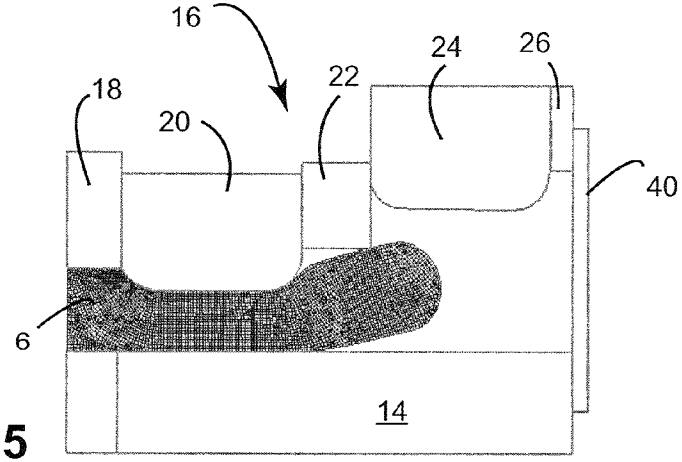
FIGS. 5 and 6 show third stage preforming using the flat bottom die and incremental split top die.
Figure 6:
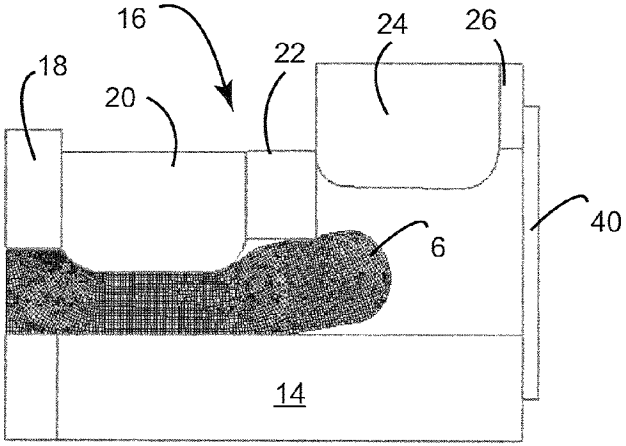

Referring to FIGS. 5 and 6, in a third stage of the preforming using the flat bottom die 14 and the top incremental split die 16, the third segment 22 is advanced to contact the workpiece 6. The third stage preforming process shown in FIGS. 5 and 6 is done at a high strain rate so as to minimize die chilling and avoid intermediate reheat processing of the workpiece 6.

Figure 8:
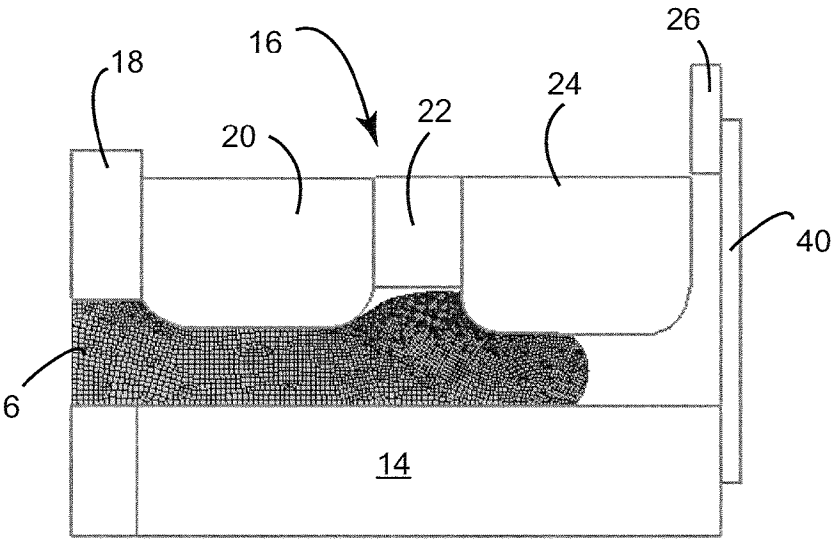
FIGS. 7 and 8 schematically depict the fourth stage preforming with the flat bottom die and incremental split top die.
Figure 7:
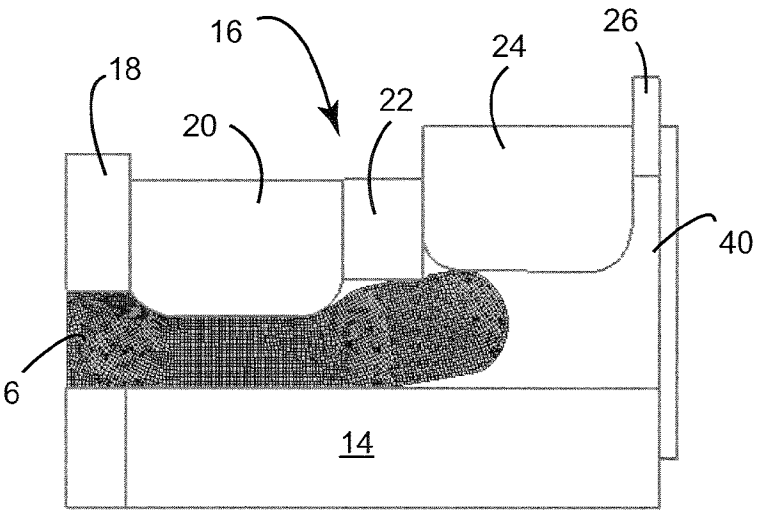

As shown in FIGS. 7 and 8, the fourth stage preforming using the flat bottom die 14 and the top incremental split die 16 is shown. The fourth segment 24 is advanced to contact the workpiece 6 as shown in FIGS. 7 and 8.

As shown in FIGS. 2-8, the four preforming stages include incremental advancements of the first segment 18, the second segment 20, the third segment 22, and the fourth segment 24 of the closed top incremental split die 16 against the flat bottom die 14. The four preforming stages are carried out at high strain rates to eliminate the intermediate heat treatment of the workpiece 6.

Figure 10:
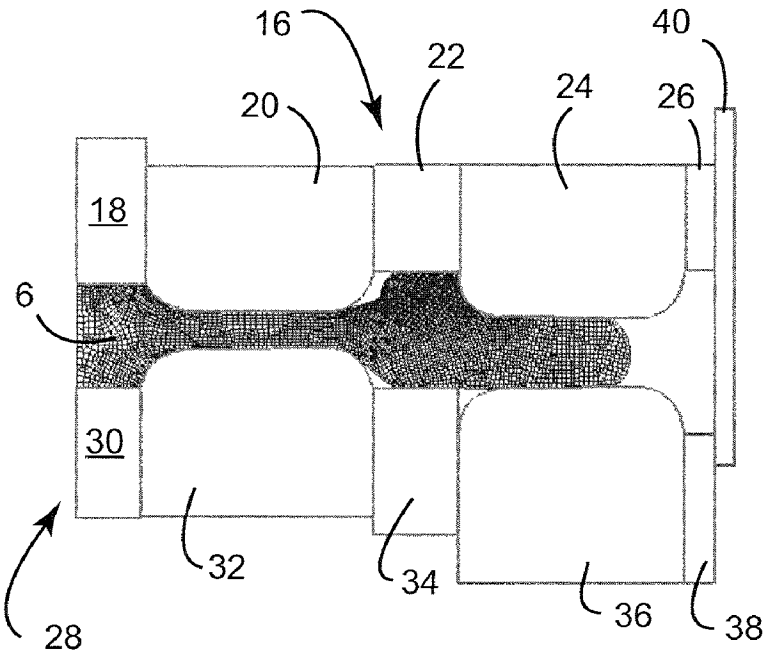
FIGS. 9 and 10 schematically depict the fifth stage preforming with a split bottom die and a stationary top die.
Figure 9:
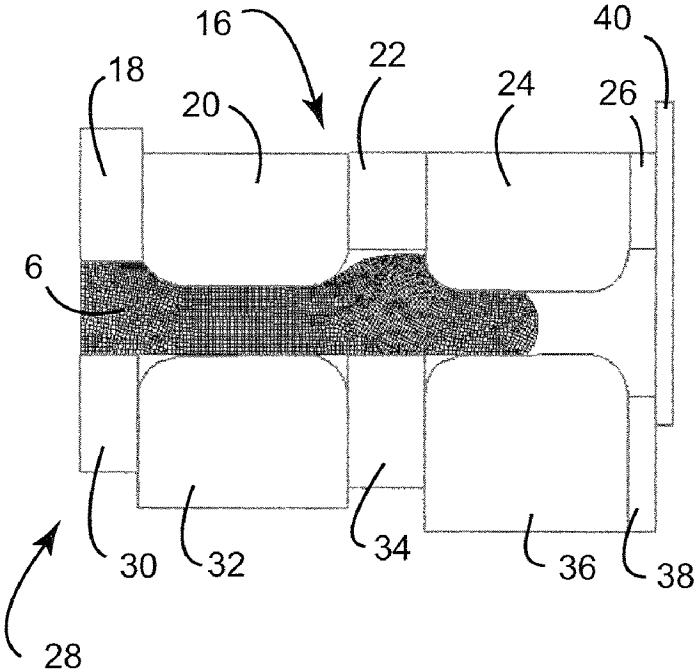

As shown in FIGS. 9 and 10, in a fifth stage of the preforming of the workpiece 6, the stationary flat bottom die 14 is replaced by a closed bottom incremental split die 28. The closed bottom incremental split die 28 includes a closed bottom die first segment 30, a second segment 32, a third segment 34, a fourth segment 36, and a fifth segment 38. The stop 40 is provided after the closed top incremental split die fifth segment 26 and the closed bottom die fifth segment 38 to provide a closed die.

As shown in FIGS. 9 and 10, the segments 18, 20, 22, 24, 26 of the closed top split die 16 remain stationary and the segments 30, 32, 34, 36, 38 of the closed bottom incremental split die 28 are advanced to further shape the workpiece 6. As shown in FIG. 15, the second segment 32 of the bottom die 28 is incrementally advanced. A heat treatment may be done on the workpiece 6 after the fifth stage preforming to bring the workpiece 6 back to temperature.

Figure 11:
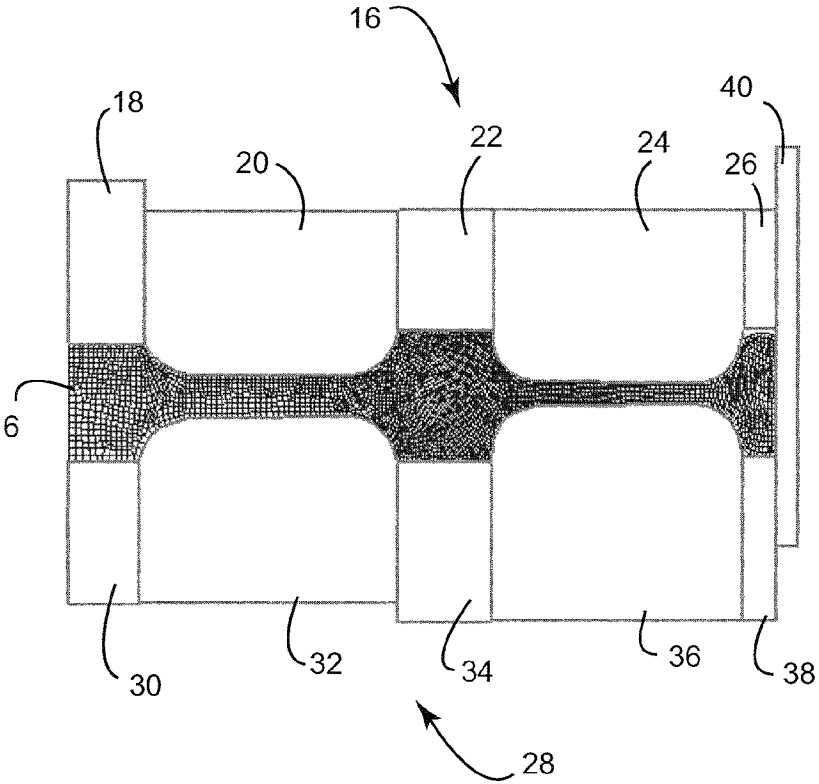
FIG. 11 schematically depicts sixth stage preforming with a split bottom die and a stationary top die.

In the sixth stage preforming, shown in FIG. 11, the fourth segment 36 of the closed bottom incremental split die 28 is advanced. The sixth stage preforming is done at a very slow strain rate to minimize the load requirements.

As shown in FIGS. 2-11, the incremental forging of the compressor and/or turbine wheels may be performed in six preforming stages. The process shown in FIGS. 2-11 may be implemented across all of the frames and stages of the compressor and/or turbine. As the rotors have a significant length in the plan view area, the multistage and multi-preforming forging schedule shown in FIGS. 2-11 may be employed. In the first four preforming stages, the material of the workpiece 6 first flows primarily in the plan view direction using the bottom flat stationary die 14 and the top incremental split die 16 at high strain rates. The incremental forging is then completed in the fifth and sixth preforming stages using the bottom incremental split die 28 and the top incremental split die 16 at slower strain rates.

The top and bottom incremental split dies may be designed so that they are modular. For example, the bore-web sections are similar for stages 2-16 of compressor wheels, rim-web sections are similar between stages 10-16 and stages 2-5. Variable rim-web sections for stages 6-9 can be represented by minimum web geometry. This permits the same basic die set to be used for various stages of wheels with minimum modifications without having the need to invest in a new die set for each stage of compressor/turbine wheels. The split die design enables a modular die design across various stages of GT wheels.

As the dies are at a lower temperature compared to the workpiece, having a thin plate made of a low thermal conductivity material at the interface between the dies and the workpiece is beneficial. This is more beneficial at the last stages of forging which are done at lower strain rates. This is desirable because die-chilling effect at the last stage could be high (due to the lower strain rates) leading to higher heat loss in the workpiece. Thus, having a thin lower conductivity material plate helps to reduce die chilling and thereby reduce the load requirements substantially.

Figure 12:
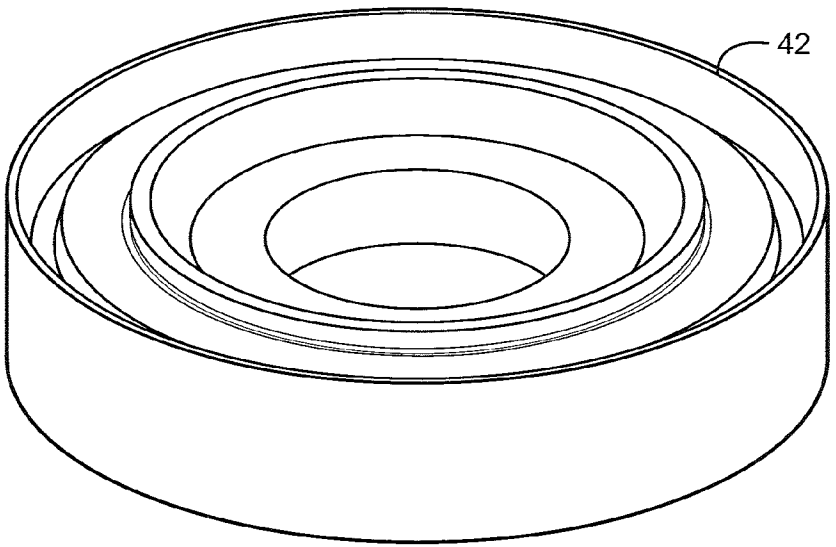
FIG. 12 schematically depicts a turbine spacer wheel.

FIG. 12 schematically depicts a turbine spacer wheel 42 which may be forged to near net shape according to an embodiment of the invention.

A billet having an initial diameter may be extruded in a die and mandrel arrangement with a container. The billet is forced through a mandrel and a punch and is shaped by an outer die including a container.

The geometry of the starting workpiece for the turbine spacer wheel may be a ring-shaped hollow profile. Such a workpiece reduces the load requirements of the incremental forging process. To achieve the ring-shaped profile, the mandrel extrusion process described above may be used. The use of mandrel extrusion for forming the workpiece starting geometry also permits subsequent drilling of the solid workpiece at the end of forging.

At the end of the extrusion process, a portion of the billet between the mandrel and the outer die and punch may be machined off to form the starting workpiece. The starting workpiece may be then used for the subsequent forging steps previously described.

Figure 13:
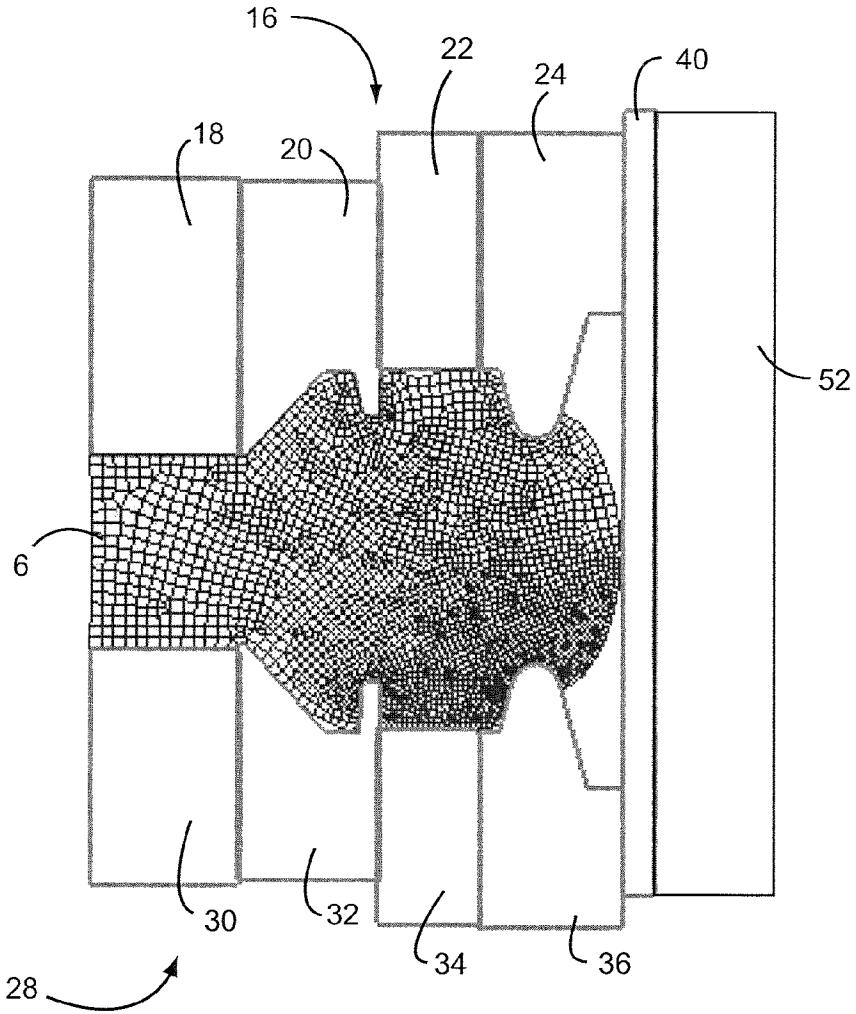
FIG. 13 schematically depicts a forging process according to another embodiment of the invention.

Referring to FIG. 13, the turbine spacer wheel 42 may be forged by the closed top incremental split die 16 and the closed bottom incremental split die 28. A shrink ring 52 may be shrink fitted onto the stop 40. The first segments 18, 30 are incrementally advanced toward one another. The second segments 20, 32 are then incrementally advanced toward one another. After incremental advancement of the first segments 18, 30, a reheat may be performed on the workpiece 6 to raise the temperature of the workpiece.

In the third and fourth preforming stages, the third die segments 22, 34 are incrementally advanced towards one another and the fourth die segments 24, 36 are incrementally advanced toward one another.

The forging of the turbine spacer wheel as described requires only one reheat cycle in the incremental forging process which may be performed after the incremental advancement of the first segments 18, 30.

Die stress analysis may be carried out after the forging process to estimate the die life. The maximum forces and stresses from the forged spacer wheel may be mapped onto the individual dies. During the forging of the turbine spacer wheel, the stop 40, which is used to control the flow of the workpiece 6, was subjected to high bursting stresses. It was also observed that a region 56 in each of the second segments 20, 32 was subjected to a very high tensile stress. The region is near the a fillet at the top region of the second segments 20, 32. The remainder of the second segments 20, 32, for example 95%, were in a safe compressive stress zone.

The forging process for forming the turbine spacer wheel may also be performed using the shrink ring 51 in place of the stop 40. In that case, the fillet region of the second segments 20, 32 were subject to less tensile stress than in the forging process using only the stop 40. As the remainder, e.g., 95% of the die regions remain in a state of compressive stress, the life of the dies is improved.

The closed die forging processes described above have been developed to permit the load requirements to be within the existing press requirement of 6 kton. The closed die forging processes described herein thus may be used with existing presses, which may have a capacity of 7 kton.

As there are currently no available closed die forgers for CrMoV and NiCrMoV compressor and turbine wheels, the use of the closed die forging processes described herein will allow use of existing forgers and provide better material properties and fracture appearance transition temperature (FATT) values. It should be appreciated, however, that other alloys may be used.

The closed die forging processes described herein also eliminate much of the required subsequent machining after the forging and thus provide a material savings of approximately 30%.

The use of the stop for restricting the material flow at the exit end of the dies permits the compressor and/or turbine wheels to be manufactured with a very high shaped difficultly factor. In addition, the use of die stress analysis to design and optimize the stop provides for a suitable shrink ring which increases the life of the stop.

The use of the incremental split dies described herein also permits the use of a modular die design across all of the stages of the compressor and/or turbine wheels. This permits the same setup of dies to be extended across all of the stages without the need for providing a new die set for each stage.

This permits the same basic modular die set to be used for all of the stages and frames of the compressor and turbine wheels.

Closed die forgings are carried out both in open air and under protective atmosphere. The closed die forging processes described herein permits the forging and heat treatment processes to be performed in air due to the die and/or workpiece geometry. This permits the use of less expensive die materials.

The preform shapes at the intermediate stages are also chosen such that the flow of the material of the workpiece 6 is primarily in one direction. The advantages of an open die configuration are thus available within the closed die described herein. This allows a lowering of the press requirements for use of a closed die.

The strain rates may also be chosen such that cooling of the workpiece is minimal. The strain rates may also be chosen so as not to increase the press requirements.

The geometry of the starting workpiece for the compressor and turbine wheels does not cover the entire plan view area of the dies. This permits the advantages of open die geometry to be obtained using a closed die. The closed die forging processes described herein may thus be thought of as a form of hybrid forging.

The geometry of the starting workpiece of the turbine spacer wheel may be a ring-shaped hollow profile. The geometry of the starting workpiece may be obtained by extrusion with a mandrel and container as described herein. The use of the hollow billet for forming the starting workpiece has at least two advantages, including, but not limited to, reducing the input material tonnage and eliminating subsequent machining. The use of the hollow billet to form the starting workpiece also reduces the load requirement during the near net shape forging.

Although the embodiments have been described in the context of forging compressor and turbine wheels and turbine spacer wheels, it should be appreciated that the process described herein may be used to forge other components, for example steam turbine rotors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A forging method, comprising:

extruding a billet to form a ring shaped hollow workpiece;

reducing a cross section of the workpiece; and forging the workpiece in a closed die comprising a first split die comprising a plurality of first die segments and a second split die comprising a plurality of second die segments by incrementally advancing a first pair of opposing die segments from the first split die and second split die towards each other and then incrementally advancing the remaining pairs of opposing die segments in sequence.

2. A method according to claim 1, further comprising heat treating the workpiece after the first pair of opposed die segments are advanced toward each other.

3. A method according to claim 2, wherein heat treating the workpiece comprises heating the workpiece to a temperature equal to a temperature of the billet during extrusion.

4. A method according to claim 2, wherein the heat treating is performed in open air.

5. A method according to claim 1, wherein the closed die is closed by a stop having a shrink fitted ring.

6. A method according to claim 1, wherein the billet is formed of CrMoV or NiCrMoV.

7. A method according to claim 1, wherein the method forges the workpiece into a turbine spacer wheel.

8. A method according to claim 1, wherein the closed die comprises a closed top incremental split die and a closed bottom incremental split die.

9. A method according to claim 1, further comprising controlling the flow of the workpiece with a stop of the closed die.

10. A method according to claim 9, wherein a shrink ring is shrink fitted onto the stop.

11. A method according to claim 1, further comprising controlling the flow of the workpiece using a shrink ring.

12. A method according to claim 1, wherein the method is performed in open air.

13. A method according to claim 1, wherein the method is performed in a protective atmosphere.

14. A method according to claim 1, wherein the workpiece does not initially cover an entire plan view area of the closed die.

15. A method according to claim 1, wherein the billet is formed of an alloy.

* * * * *

UNITED STATES PATENT AND TRADEMARK OFFICE

CERTIFICATE OF CORRECTION

PATENT NO. : 8,256,260 B2
APPLICATION NO. : 13/017181
DATED : September 4, 2012
INVENTOR(S) : Mathai et al.

It is certified that error appears in the above-identified patent and that said Letters Patent is hereby corrected as shown below:

At column 4, line 35, delete "using the shrink ring 51" and insert --using the shrink ring 52--

Signed and Sealed this
Eleventh Day of December, 2012

David J. Kappos

David J. Kappos
*Director of the United States Patent and Trademark Office*